United States Patent [19]

Iino

[11] 4,302,995

[45] Dec. 1, 1981

[54] APPARATUS FOR BLANKING METAL SHEET HAVING PARTS OF WELDED CONNECTION

[75] Inventor: Toshio Iino, Ibaragi, Japan

[73] Assignee: Daiwa Can Company, Limited, Tokyo, Japan

[21] Appl. No.: 132,699

[22] Filed: Mar. 21, 1980

[30] Foreign Application Priority Data

Aug. 30, 1978 [JP] Japan ..... 53-118790

[51] Int. Cl.[3] ..... B26D 7/18

[52] U.S. Cl. ..... 83/104; 83/80; 83/106; 83/202; 83/234; 83/528; 83/923

[58] Field of Search ..... 83/80, 104, 106, 234, 83/255, 202, 528

[56] References Cited

U.S. PATENT DOCUMENTS 2,047,221 7/1936 Pechy ..... 83/106 X 3,157,083 11/1964 Roberts ..... 83/923 X

FOREIGN PATENT DOCUMENTS 2005177 4/1979 United Kingdom ..... 83/923

*Primary Examiner*—J. M. Meister

*Attorney, Agent, or Firm*—Daley & Brandt

[57] ABSTRACT

In continuously blanking a coiled metal sheet, an operator rapidly detects parts of welded connection of a metal sheet without any manual touch of the metal sheet, removes the parts of welded connection and restarts the apparatus for blanking the metal sheet.

1 Claim, 5 Drawing Figures

APPARATUS FOR BLANKING METAL SHEET HAVING PARTS OF WELDED CONNECTION

BACKGROUND OF THE INVENTION

The present invention relates to an apparatus for continuously blanking a coiled metal sheet without blanking parts of welded connection of said sheet, having means for detecting said parts of welded connection, means for cutting said parts of welded connection, and means for removing the cut parts of welded connection.

Generally in a coiled metal sheet, an end part of a metal sheet is lap-welded to an end of another metal sheet when a defect part is cut off from the metal sheet or when the metal sheet is short in length. The parts of such welded connection cannot be generally used as a product even if shaped, and since such parts have a double thickness, the edge of blanking cutter blade will be damaged, if blanked as such, and furthermore processing tools of the successive steps will be also damaged. Thus, the parts of welded connection of a metal sheet must be detected and removed before such parts enter the apparatus for blanking the metal sheet.

One example of such an apparatus for blanking a metal sheet is a cup shaping press, where an operation of the cup shaping press is stopped as soon as a part of welded connection of the metal sheet is detected before that part enters the cup shaping press; the part of welded connection is pulled out manually from said press and cut off by metal scissors; then a cut end of the successive metal sheet is put into the cup shaping press, and then the cup shaping press is restarted. Since the metal sheet has a considerable width, at least two operators are required for said operations, and also there is a risk of damages to hands, etc., because the metal sheet is generally handled manually, that is, by direct touch with hands. Furthermore, a long time is required till the cup shaping press is restarted.

SUMMARY OF THE INVENTION

One object of the present invention is to provide an apparatus for continuously blanking a metal sheet enabling an operator to rapidly remove parts of welded connection without any touch of the metal sheet by hands and restart an apparatus for blanking the metal sheet such as a cup shaping press.

The present invention provides an apparatus for continuously blanking a continued metal sheet having parts of welded connection comprising a press for continuously blanking a continued metal sheet, which comprises a vertically movable upper press member, a fixed lower press member provided against the upper press member, a pair of an upper feed roll and a lower feed roll provided at the lower press member at a place where the metal sheet enters between said upper press member and lower press member to intermittently advance the metal sheet by a definite length through between said two press members, an upper scrap cutter provided at the upper press member and a lower scrap cutter fixed at the lower press member at a place where the metal sheet leaves between said two press members and a scrap conveyor provided at the outside of the lower press member and near the lower scrap cutter, characterized by a device of placing the upper scrap cutter in interlocking on or off the upper press member, a device of elevating the upper feed roll, a pair of an upper subfeed roll and a lower subfeed roll for continuously and quickly advancing the metal sheet after the upper feed roll is elevated, a freely extendable slide guide being provided near and above the scrap conveyor and at a side opposite to the press with respect to the scrap conveyor and being extendable over the scrap conveyor, and an electric controller of sequentially actuating the device of placing the upper scrap cutter in interlocking on or off the upper press member, the upper feed roll, a pair of the subfeed rolls, and the salide guide.

PREFERRED EMBODIMENT OF THE INVENTION

Figure 1:
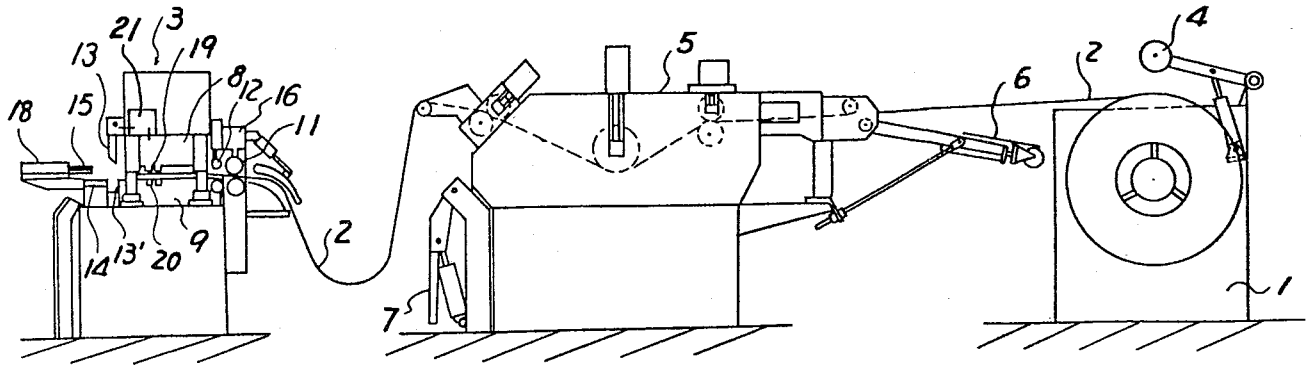
FIG. 1 is a side view showing a series of machines in a normal operating state for applying a lubricant to a coiled continued metal sheet, and blanking and shaping the metal sheet into cups.

A preferred embodiment of the present invention will be described in detail below, referring to the drawings.

In FIG. 1, numeral 1 is an uncoiler provided with a coiled metal sheet 2 for gradually uncoiling the coiled metal sheet and continuously feeding the metal sheet to a cup shaping press 3. Numeral 4 is a snapper roll for preventing a free release of the coiled metal sheet 2 by pressing when a fresh coiled metal sheet 2 is set in the uncoiler 1 and an end of the metal sheet 2 is drawn out and put into a waxer 5, where a tape at the tip end of the coiled metal sheet 2 is peeled off (the snapper roll 4 is lifted above the coiled metal sheet 2 by an air cylinder). Numeral 5 is a waxer provided between the uncoiler 1 and the cup shaping press 3 and directed to applying a lubricant to the coiled metal sheet 2 being continuously fed from the uncoiler 1. A guide slide table 6, whose tip end part is freely extendable, from the waxer 5 towards the uncoiler 1, for guiding the tip end of the fresh coiled metal sheet 2 into the waxer 5, is provided at the waxer 5. A feed table 7, which can be horizontally extended from the waxer 5 towards the cup shaping press 3 and support the metal sheet 2 to make it easy to put the tip end of the fresh coiled metal sheet 2 into the cup shaping press 3, is provided at the waxer 5.

The cup shaping press 3 has a cutter for blanking the metal sheet 2 into a disk (the cutter being not shown in the drawing, but an upper blade being fixed to a vertically movable upper press member 8 and a lower blade being fixed to a fixed lower press member 9), a punch core 19 and a die ring 20 (both shown by a dotted line) which are used for shaping the disc into a cup, and a conveyor for transporting the shaped cup, and is further provided with feed rolls 11 and 11' for intermittently feeding the metal sheet 2 by a definite length into the inside of the cup shaping press 3, and subfeed rolls 12 and 12′ for continuously passing a part of welded connection of the metal sheet 2 through between the upper press member 8 and the fixed lower press member 9 while the operation of the cup shaping press 3 is stopped, at the side towards the waxer 5, the feed rolls 11 and 11′ and the subfeed rolls 12 and 12′ being provided at the fixed lower press member 9, and further with an upper scrap cutter 13, selectively operable means 21 for interlocking the upper scrap cutter with the upper press member 8 for movement therewith (any type of well-known interlocking means can be used in this invention) and a lower scrap cutter 13′ fixed to the lower press member 9 for shredding the metal sheet blanked off the cup (scrap), a scrap conveyor 14 for transporting the shredded scrap, and a slide guide 15 freely extendable for receiving the initial part of coiled metal sheet or the parts of welded connection of the metal sheet when they are removed from the metal sheet, at the outlet side of the metal sheet 2 (at the left side of the cup shaping press 3 in FIG. 1).

Figure 2:
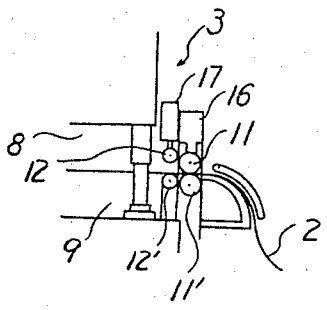
FIG. 2 is a partially enlarged view showing positions of feed rolls and subfeed rolls in a normal operating state.
Figure 4:
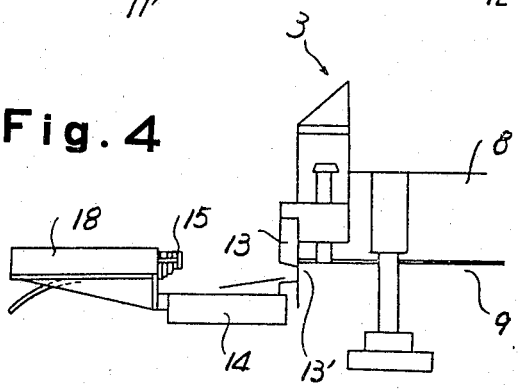
FIG. 4 is a partially enlarged view showing a state of scrap cutters, a scrap conveyor and a slide guide at the normal operation.
Figure 5:
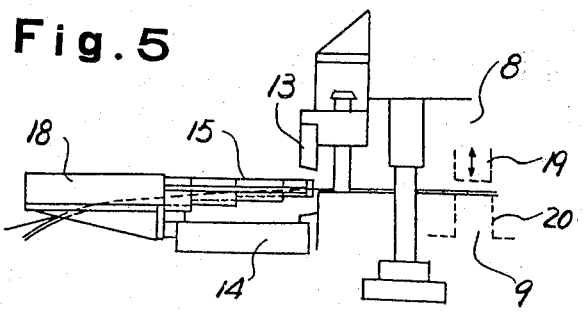
FIG. 5 is a partially enlarged view showing a state of scrap cutters, a scrap conveyor and a slide guide when a part of welded connection is removed.

When the cup shaping press is in continuous operation, the uncoiler 1, the metal sheet 2, the waxer 5, the cup shaping press, and their accessories are substantially in the state at positions shown in FIG. 1, and the feed rolls 11 and 11′, the subfeed rolls 12 and 12′, the scrap cutter 13 and 13′, and the slide guide 15 in the cup shaping press 3 are at positions shown in FIGS. 2 and 4. That is, the continued metal sheet 2 is coated with a lubricant in the waxer 5, and intermittently fed into the inside of the cup shaping press 3 (at the right side of the cup shaping press 3 in FIG. 1) by a definite length by the feed rolls 11 and 11′, and blanked into a disc by the cutter in the cup shaping press. The blank disc is shaped into a cup by drawing by means of the punch core 19 and the die ring 20, and the shaped cup is transported by a cup conveyor (not shown in the drawing) provided under the die ring 20. The remaining metal sheet blanked off the disc is shredded by the upper scrap cutter 13 vertically movable in synchronizing with the vertical movement of the punch core 19 (or the upper blade), and the fixed lower scrap cutter 13′, and transported by the scrap conveyor 14.

Figure 3:
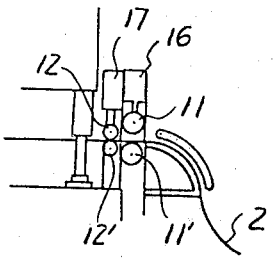
FIG. 3 is a partially enlarged view showing positions of feed rolls and subfeed rolls at quick advancing of a metal sheet after a part of welded connection is detected.

A part of welded connection of the continued metal sheet 2 is detected by a detector provided between the waxer 5 and the cup shaping press 3 (at the right side of the cup shaping press in FIG. 1). Any type of detector can be used, and is not shown in the drawings. One example of it is such that a hole of definite size is provided near the part of welded connection of the metal sheet 2, a light is continuously thrown onto the metal sheet from one side of it, whereas a light detector is provided at the corresponding position at the other side of the metal sheet, and when the hole part of the metal sheet passes over the position of the detector, the light passed through the hole is always detected by the light detector at the corresponding position at the opposite side. When the part of welded connection is detected, the upper press member 8 is stopped at an elevated position (upper dead point) by an order of an electric controller when the part of welded connection of the metal sheet 2 is advanced to a position just before the blanking cutter, and at the same time, intermitten feeding by the feed rolls 11 and 11′ is stopped. Then, the upper feed roll 11 at the side of the cup shaping press 3 towards the waxer 5 is elevated by an air cylinder 16 and at the same time the upper subfeed roll 12 is made lower by an air cylinder 17 to pinch the metal sheet 2 between the subfeed rolls 12 and 12′, as shown in FIG. 3.

On the other hand, the upper scrap cutter 13 at the opposite side of the cup shaping press 3 is elevated by an air cylinder (not shown in the drawings), and at the same time the slide guide 15 is extended horizontally towards the cup shaping press 3, over the scrap conveyor 14 by an air cylinder 18. Then, the part of welded connection of the metal sheet 2 is quickly advanced to the outside of the cup shaping press 3 by means of the subfeed rolls 12 and 12′ while keeping the upper press member 8 at the position of upper dead point. During that time, the tip end of the part of welded connection is fed on the slide guide 15 and stopped. Then, the upper subfeed roll 12 is elevated to release the pinching of the metal sheet 2 between the subfeed rolls 12 and 12′, and the upper feed roll 11 is made lower to pinch the metal sheet between the feed rolls 11 and 11′. Then, a cup is blanked out while keeping the upper scrap cutter 13 at the elevated position and the slide guide 15 at the extended position, and when the blanked part is intermittently advanced to the position of the scrap cutters 13 and 13′, the upper scrap cutter 13 is interlocked on the upper press member to move downwards and cut off the blanked part. The slide guide 15 is retreated to remove the metal sheet having the part of welded connection from the cup shaping press 3. The upper scrap cutter 13 is not made lower until the blanked part is reached above the lower scrap cutter.

Then, the operation of the cup shaping press 3 is restarted.

These operations are carried out sequentially by the electric controller.

As described above, a pair of quickly rotatable subfeed rolls, one of which is vertically movable, is provided at the inlet side of metal sheet in the cup shaping press, and also the upper feed roll of a pair of intermittently rotatable feed rolls is made vertically movable. Furthermore, an upper scrap cutter capable of being placed in interlocking on or off the upper press member and a slide guide freely extendable over the scrap conveyor are provided at the outside of the cup shaping press. Thus, a series of the operations such as stopping of the operation of the cup shaping press, cutting and removal of the part of welded connection of the metal plate, and restarting the operation of the cup shaping press can be carried out only by one operator only through manipulation of a control panel without any touch of a metal sheet with hands. That is, an operating labor can be considerably saved with elimination of a risk of damages to fingers or hands. Furthermore, much time is no more required in cutting the part of welded connection in the present invention than that in the conventional art, and also it is not required to place manually the tip end of the successive metal sheet into the cup shaping press. A production efficiency can be more effectively improved.

In the foregoing embodiment, a cup shaping press used for producing a two-piece can has been described, but the present invention can be applied not only to such cup shaping press, but also to an ordinary apparatus for blanking a continued metal sheet.

The foregoing description shows one embodiment of the present invention, and the present invention will not be limited thereto. The present invention can be modified in the scope thereof so long as it is not deviated from the spirit of the present invention.

What is claimed is:

1. An apparatus for continuously blanking a continued metal sheet having parts of welded connection comprising a press for continuously blanking a continued metal sheet, which comprises a vertically movable upper press member, a fixed lower press member provided against the upper press member, a pair of an upper feed roll and a lower feed roll provided at the lower press member at a place where the metal sheet enters between said upper press member and lower press member to intermittently advance the metal sheet by a definite length through between said two press members, an upper scrap cutter provided at the upper press member and a lower scrap cutter fixed at the lower press member at a place where the metal sheet leaves between said two press members, and a scrap conveyor provided at the outside of the lower press member and near the lower scrap cutter, characterized by selectively operable means for interlocking the upper scrap cutter with the upper press member for movement therewith, a device of elevating the upper feed roll, a pair of an upper subfeed roll and a lower subfeed roll for continuously and quickly advancing the metal sheet after the upper feed roll is elevated, a freely extendable slide guide being provided near and above the scrap conveyor and at a side opposite to the press with respect to the scrap conveyor and being extendable over the scrap conveyor, and an electric controller of sequentially actuating said interlocking means, the upper feed roll, a pair of the subfeed rolls, and the slide guide.

* * * * *

UNITED STATES PATENT AND TRADEMARK OFFICE

CERTIFICATE OF CORRECTION

PATENT NO. : 4,302,995

DATED : December 1, 1981

INVENTOR(S) : Tshio Iino

It is certified that error appears in the above-identified patent and that said Letters Patent are hereby corrected as shown below:

Delete the following:

-- Foreign Application Priority Date August 30, 1978 [JP] Japan .....53-118790 --

Signed and Sealed this

*Eighteenth* Day of *May 1982*

[SEAL]

*Attest:*

GERALD J. MOSSINGHOFF

*Attesting Officer*

*Commissioner of Patents and Trademarks*